US005574266A

United States Patent [19]

Wells

[11] Patent Number: 5,574,266

[45] Date of Patent: Nov. 12, 1996

[54] DEVICE FOR ENHANCING CONTACT CLOSURE TIME OF A DECELERATION SENSOR SWITCH FOR USE IN A VEHICLE OCCUPANT RESTRAINT SYSTEM

[75] Inventor: Roger F. Wells, Yorba Linda, Calif.

[73] Assignee: TRW Technar Inc., Irwindale, Calif.

[21] Appl. No.: 310,582

[22] Filed: Sep. 22, 1994

[51] Int. Cl.[6] ..... H01H 35/14

[52] U.S. Cl. ..... 200/61.53

[58] Field of Search ..... 200/61.45 R–61.45 M

[56] References Cited

U.S. PATENT DOCUMENTS

| | | | |
|---|---|---|---|
| 3,489,917 | 1/1970 | Gurol | 307/121 |
| 3,549,169 | 12/1970 | Oldberg et al. | 280/150 |
| 3,571,539 | 3/1971 | Kaiser et al. | 200/61.53 |
| 3,753,475 | 8/1973 | Andersen et al. | 180/91 |
| 3,789,949 | 2/1974 | Bortfeld et al. | 180/91 |
| 3,974,350 | 8/1976 | Breed | 200/61.53 |
| 4,284,863 | 8/1981 | Breed | 200/61.53 |
| 4,536,629 | 8/1985 | Diller | 200/61.45 R |
| 4,973,804 | 11/1990 | Cook et al. | 200/61.48 |
| 5,059,751 | 10/1991 | Woodman et al. | 200/61.45 M |
| 5,118,908 | 6/1992 | Bolender | 200/61.45 R |

*Primary Examiner*—Brian W. Brown
*Assistant Examiner*—Michael A. Friedhofer
*Attorney, Agent, or Firm*—Tarolli, Sundheim, Covell, Tummino & Szabo

[57] ABSTRACT

A deceleration sensor switch (10) comprises electrical contacts (50, 52) and a mass (14) movable between an unactuated position in which the electrical contacts are open and an actuated position in which the electrical contacts are closed. The mass is biased towards the unactuated position. A cylinder (30) includes an end portion (44) and a cylindrical wall portion (34) extending from the end portion to define a chamber (35) inside the cylinder. The end portion includes a metering orifice (36) for allowing air to flow between the chamber and outside the cylinder. A shaft (22) interconnects the mass and a truncated cone (24). The cone has a skirt end (26) and is movable in one direction relative to the chamber to displace air from the chamber through the metering orifice to outside the cylinder upon the mass moving from the unactuated position to the actuated position in response to the mass being subjected to deceleration of at least a predetermined magnitude. The cone is movable in an opposite direction relative to the chamber to cause air from outside the cylinder to flow through the metering orifice into the chamber upon the mass moving from the actuated position back to the unactuated position, thereby enhancing contact closure time of the electrical contacts.

19 Claims, 2 Drawing Sheets

DEVICE FOR ENHANCING CONTACT CLOSURE TIME OF A DECELERATION SENSOR SWITCH FOR USE IN A VEHICLE OCCUPANT RESTRAINT SYSTEM

BACKGROUND OF THE INVENTION

1. Technical Field

The present invention relates to a deceleration sensor switch, and, in particular relates to a vehicle deceleration sensor switch for use in a vehicle occupant restraint system.

2. Background Art

Vehicle deceleration sensor switches for use in a vehicle occupant restraint system, such as an inflatable air bag system, are known. Typically, a vehicle deceleration sensor switch has electrical contacts which close in response to the vehicle experiencing deceleration of at least a predetermined magnitude for a time interval, such as occurs in a vehicle collision. Upon closing of the contacts, a firing circuit is completed which triggers an inflator to provide a flow of inflation fluid. The inflation fluid is directed into an inflatable air bag to inflate the air bag. The inflated air bag absorbs energy resulting from the movement of the vehicle occupant against the air bag and prevents the vehicle occupant from violently striking parts of the vehicle during the vehicle collision.

The contacts of the deceleration sensing switch must remain closed for a sufficient time to ensure reliable completion of the firing circuit and thereby reliable inflation of the air bag. Some known deceleration sensor switches may use frictional resistance to prolong contact closure time, such as disclosed in U.S. Pat. Nos. 3,753,475 and 3,571,539.

SUMMARY OF THE INVENTION

In accordance with the present invention, a deceleration sensor switch has electrical contacts, a mass movable between an unactuated position in which the contacts are open and an actuated position in which the contacts are closed, and a device for enhancing contact closure time. The device for enhancing contact closure time creates at least a partial vacuum which resists movement of the mass from the actuated position to the unactuated position, thereby enhancing closure time of the contacts.

Preferably, the device which creates at least a partial vacuum includes a cylinder having a wall portion comprising a metal material or a metallized plastic material. The wall portion of the cylinder defines a chamber. A truncated cone is connected with the mass and is received in the chamber of the cylinder when the mass is in the actuated position. Preferably, the cone comprises a flexible plastic material and has an outer surface which fits snugly against an inner surface of the wall portion of the cylinder when the mass is in the actuated position. The cone cooperates with the wall portion of the cylinder to create a partial vacuum in the chamber of the cylinder as the mass moves from the actuated position to the unactuated position. This partial vacuum resists movement of the mass.

In a second embodiment of the present invention, the truncated cone comprises a flexible plastic material, and the wall portion of the cylinder comprises a metal material. An electrically conductive contact ring is disposed on the cone. The contact ring is plated on the flexible plastic material of the cone and is electrically connected with the metal material of the wall portion of the cylinder when the cone is received in the chamber of the cylinder. The contact ring and the wall portion of the cylinder form the electrical contacts of the deceleration sensor switch. The contact closure time of the electrical contacts of the deceleration sensor switch in the second embodiment of the present invention is enhanced in the same way that the contact closure time of the electrical contacts of the deceleration sensor switch in the first embodiment of the present invention is enhanced.

In a third embodiment of the present invention, the truncated cone comprises a flexible plastic material, and the wall portion of the cylinder comprises a plastic molded material. An internal plated electrically conductive first contact ring is disposed on the plastic molded material of the cylinder. An electrically conductive second contact ring is disposed on the flexible plastic material of the cone and is electrically connected with the first contact ring when the cone is received in the chamber of the cylinder. The first and second contact rings form the electrical contacts of the deceleration sensor switch. The contact closure time of the electrical contacts of the deceleration sensor switch in the third embodiment of the present invention is enhanced in the same way that the contact closure time of the electrical contacts of the deceleration sensor switch in the first embodiment of the present invention is enhanced.

In a fourth embodiment of the present invention, the truncated cone comprises a flexible plastic material, and the wall portion of the cylinder comprises a plastic molded material. An internal plated electrically conductive first contact ring is disposed on the plastic molded material of the cylinder. An electrically conductive first arcuate contact portion is disposed on part of the flexible plastic material of the cone and is electrically connected with the first contact ring when the cone is received in the cheer of the cylinder. An electrically conductive second arcuate contact portion is disposed on another part of the flexible plastic material of the cone and is electrically connected with the first contact ring and thereby with the first arcuate contact portion when the cone is received in the chamber of the cylinder. The first and second arcuate contact portions form the electrical contacts of the deceleration sensor switch. The contact closure time of the electrical contacts of the deceleration sensor switch in the fourth embodiment of the present invention is enhanced in the same way that the contact closure time of the electrical contacts of the deceleration sensor switch in the first embodiment of the present invention is enhanced.

BRIEF DESCRIPTION OF THE DRAWINGS

The foregoing and other features of the present invention will become apparent to one skilled in the art to which the present invention relates upon consideration of the following description of the invention with reference to the accompanying drawings, wherein.

DESCRIPTION OF PREFERRED EMBODIMENTS

Figure 1:
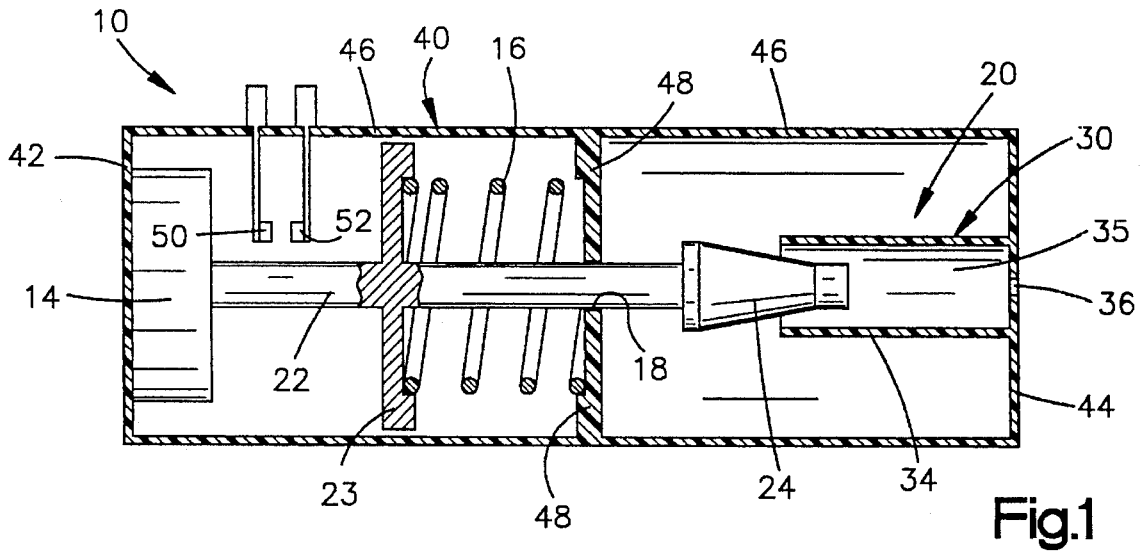
FIG. 1 is a sectional view of a deceleration sensor switch embodying the present invention.

The present invention is directed to a device for enhancing contact closure time of a deceleration sensor switch. The specific construction of the device may vary. A deceleration sensor switch 10 embodying the present invention is illustrated in FIG. 1.

The deceleration sensor switch 10 includes a housing 40 having opposite circular end portions 42, 44 and a cylindrical wall portion 46 interconnecting the circular end portions 42, 44. A set of electrical contacts including first and second contacts 50, 52 are disposed on the wall portion 46 of the housing 40. The housing 40 includes a ring-shaped flange portion 48 extending from the wall portion 46 and located inside the housing 40. The flange portion 48 has a centrally located opening 18.

The deceleration sensor switch 10 further includes a mass 14 and an extension shaft 22 having one end connected to the mass 14 in a suitable manner. The shaft 22 has an annular flange portion 23 located in the central area of the shaft 22. The shaft 22 extends through the opening 18 in the flange portion 48 of the housing 40. The flange portion 48 of the housing 40 and the flange portion 23 of the shaft 22 cooperate to support the shaft 22 for sliding movement along the longitudinal central axis of the shaft 22.

A spring 16 is disposed between the flange portion 48 of the housing 40 and the flange portion 23 of the shaft 22 to provide a spring force which biases the mass 14 against the end portion 42 of the housing 40. When the mass 14 is against the end portion 42 of the housing 40, the mass 14 is in an unactuated position and the first and second contacts 50, 52 are open. The mass 14 is movable from the unactuated position towards the right, as viewed in FIG. 1, to an actuated position (not shown) in response to the mass 14 being subjected to a deceleration force of at least a predetermined magnitude for a sufficient time interval, such as occurs in a vehicle collision. The spring 16 is compressed when the mass 14 moves toward the right, as viewed in FIG. 1.

As the mass 14 moves towards the right, as viewed in FIG. 1, the mass 14 engages the first contact 50 and deflects the first contact 50 toward the second contact 52. As the mass 14 continues to move toward the right, the first contact 50 will engage the second contact 52 to form an electrical connection and then both contacts may deflect. The mass 14 reaches an actuated position, in which the first contact 50 engages the second contact 52, when the spring force of the spring 16 is sufficient to stop movement of the mass 14 toward the right, as viewed in FIG. 1. The first and second contacts 50, 52 remain engaged and electrically connected with each other as the mass 14 remains in its actuated position.

In accordance with the present invention, a device 20 is operatively connected with the mass 14 for enhancing the contact closure time of the first and second contacts 50, 52 after the mass 14 has moved to an actuated position. The device 20 includes a truncated cone 24 which is attached to the end of the shaft 22 which is opposite the mass 14. The cone 24 may be attached to the shaft 22 by a rivet, heat staking, a screw, or other suitable means. Preferably, the cone 24 comprises a flexible and compressible plastic material such as a polyimide material.

Figure 2:
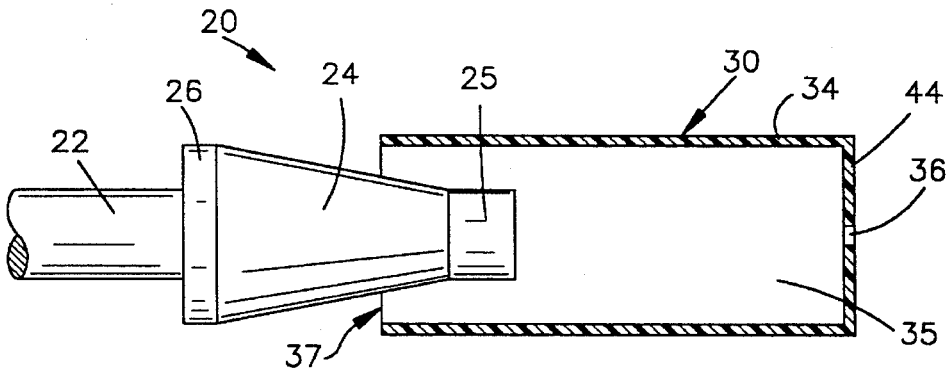
FIG. 2 is an enlarged view of a portion of the deceleration sensor switch of FIG. 1.

Referring to FIGS. 1 and 2, the device 20 further comprises a cylinder 30 having a cylindrical wall portion 34 extending from the end portion 44 of the housing 40. Preferably, the wall portion 34 of the cylinder 30 comprises a metal material or a metallized plastic material. The end portion 44 and the wall portion 34 define a chamber 35 inside the cylinder 30. The cylinder 30 has an open end 37 (FIG. 2) which communicates the chamber 35 with the outside of the cylinder 30. The end portion 44 of the housing 40 has a metering orifice 36 located in the center of the end portion 44. The metering orifice 36 communicates the chamber 35 with the outside of the housing 40.

The cone 24 includes a truncated end 25 having an outer diameter which is smaller than the inner diameter of the cylinder 30. Preferably, the outer diameter of the truncated end 25 of the cone 24 is smaller than the inner diameter of the cylinder 30 by about 20% to 40%. The cone 24 further includes a skirt end 26 located opposite the truncated end 25. The skirt end 26 has an outer diameter which is slightly larger than the inner diameter of the cylinder 30.

When the mass 14 is in its unactuated position, the first and second contacts 50, 52 are open and the shaft 22 and the cone 24 are in their positions shown in FIG. 2. When the mass 14 has moved to cause the first and second contacts 50, 52 to engage, the shaft 22 and the cone 24 are in their positions shown in FIG. 3. If the mass 14 continues to move after the first and second contacts 50, 52 engage, the first and second contacts 50, 52 remain engaged and the shaft 22 and the cone 24 move to their positions shown in FIG. 4.

Figure 3:
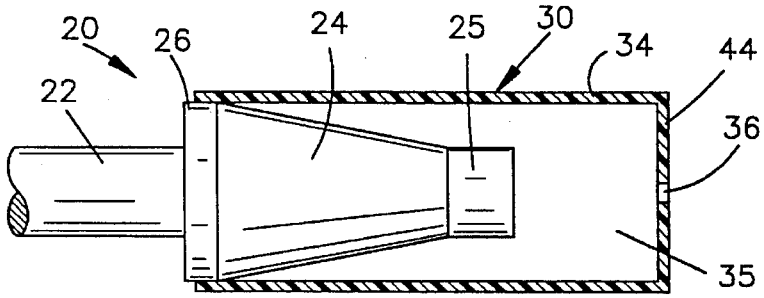
FIG. 3 is a view similar to FIG. 2 but showing parts in different positions.

When the cone 24 reaches the position shown in FIG. 3, the skirt end 26 of the cone 24 compresses and fits snugly against the inner surface of the wall portion 34 of the cylinder 30. The skirt end 26 compresses because of the compressibility and flexibility of the polyimide material of the cone 24. When the skirt end 26 of the cone 24 compresses and fits snugly against the inner surface of the wall portion 34 of the cylinder 30, an air-tight seal is formed between the outer surface of the skirt end 26 of the cone 24 and the inner surface of the wall portion 34 of the cylinder 30.

Figure 4:
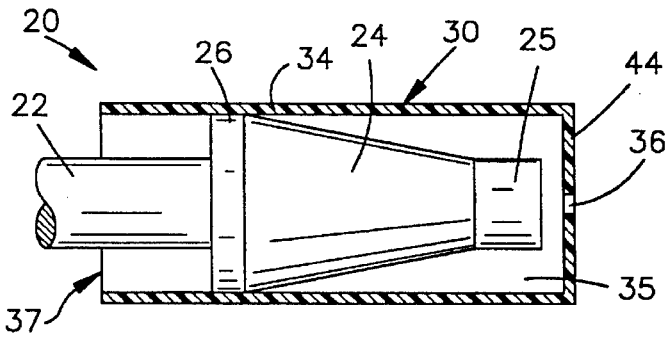
FIG. 4 is a view similar to FIG. 3 but showing parts in still different positions.

The formation of the air-tight seal between the cone 24 and the cylinder 30 and the continued sliding movement of the cone 24 from the position shown in FIG. 3 to the position shown in FIG. 4 causes the pressure in the chamber 35 in the cylinder 30 to increase, and air is expelled from the chamber 35 in the cylinder 30 through the metering orifice 36 to the outside of the housing 40.

After the deceleration forces which caused the mass 14 to move from its unactuated position to its actuated position dissipate, the returning force of the spring 16 causes the mass 14 to move from its actuated position toward its unactuated position. As this occurs, the cone 24 slides from the position shown in FIG. 4 toward the position shown in FIG. 3. The sliding movement of the cone 24 from the position shown in FIG. 4 toward the position shown in FIG. 3 is resisted by a resisting force which acts on the cone 24. This resisting force results from the pressure gradient between a partial vacuum created inside the chamber 35 and the ambient air pressure which acts on the radially extending end surface of the skirt end 26 of the cone 24. Due to the resisting force acting on the cone 24, the cone 24 moves relatively slowly from the position shown in FIG. 4 toward the position shown in FIG. 3.

When the cone 24 is in the position shown in FIG. 4, air outside the housing 40 slowly enters through the metering orifice 36 which gradually increases the pressure in the chamber 35. As the pressure in the chamber 35 gradually increases, the returning force of the spring 16 biases the mass 14 and the cone 24 relatively slowly from the position shown in FIG. 4 toward the position shown in FIG. 3. By moving the mass 14 and the cone 24 relatively slowly from the position shown in FIG. 4 to the position shown in FIG. 3, the contact closure time of the first and second contacts 50, 52 is enhanced.

The rate at which the cone 24 slides from the position shown in FIG. 4 to the position shown in FIG. 3 depends upon the rate of air flow from outside the housing 40 through the metering orifice 36 into the chamber 35. The rate of air flow into the chamber 35 is determined by the size and geometry of the metering orifice 36. The size and geometry of the metering orifice 36 can be adjusted to provide the desired rate of air flow through the metering orifice 36 and thereby the desired enhancement of the contact closure time of the first and second contacts 50, 52.

After the skirt end 26 moves out of chamber 35, the air-tight seal between the cone 24 and the cylinder 30 is dissipated. Thus, the pressure in chamber 35 becomes ambient pressure and the cone 24 will move to the position shown in FIG. 2 due to the returning force of the spring 16 acting on the mass 14 without resistance due to a pressure gradient acting on the cone 24.

A number of advantages are achieved by providing the deceleration sensor switch 10 with the device 20 in accordance with the present invention. One advantage is that the contact closure time of the deceleration sensor switch 10 is increased by several orders of magnitude with only a relatively small increase in the travel distance of the mass 14. Another advantage is that the device 20 is purely a mechanical device which does not require any form of electrical latch. This increases the reliability of the deceleration sensor switch 10 and decreases the cost and complexity of the deceleration sensor switch 10.

Figure 5:
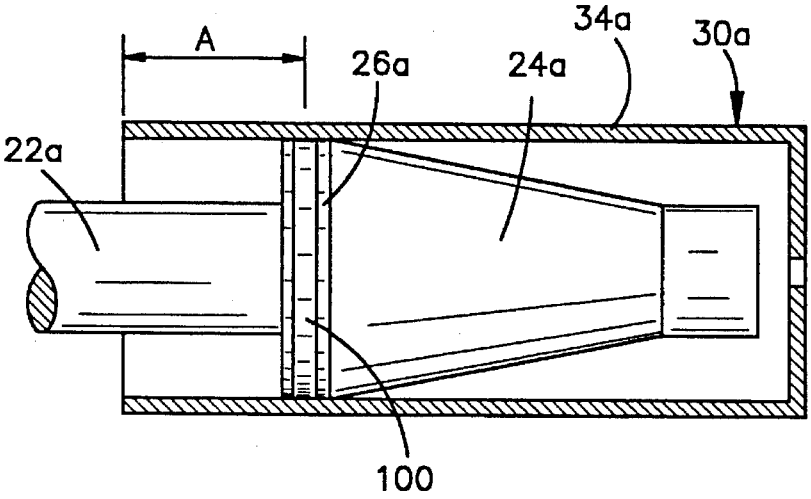
FIG. 5 is a view similar to FIG. 4 and showing a second embodiment of the present invention.

A second embodiment of the present invention is illustrated in FIG. 5. Since the embodiment of the invention illustrated in FIG. 5 is generally similar to the embodiment of the invention illustrated in FIGS. 1–4, similar numerals are utilized to designate similar components, the suffix letter "a" being added to the embodiment of FIG. 5 to avoid confusion.

Referring to FIG. 5, the mass (not shown) of the deceleration sensor switch (also not shown) is in an actuated position. The cylinder 30*a* is made of a metal material and is a first electrical contact. A ring 100 is plated on the outside surface of the skirt end 26*a* of the cone 24*a*. The ring 100 is made of electrically conductive material and is a second electrical contact. It is conceivable that the shaft 22*a* may be made of an electrically conductive material which is electrically connected with the ring 100.

The first and second electrical contacts formed by the cylinder 30*a* and the ring 100 are electrically connected with each other when the cone 24*a* is in the position shown in FIG. 5. The first and second electrical contacts formed by the cylinder 30*a* and the ring 100 are the set of electrical contacts of the deceleration sensor switch. The contact closure time of the set of electrical contacts of the deceleration sensor switch in the embodiment of FIG. 5 is enhanced in the same way that the contact closure time of the first and second contacts 50, 52 of the deceleration sensor switch 10 in the embodiment of FIGS. 1–4 is enhanced.

During movement of the mass to the actuated position and the cone 24*a* to the position shown in FIG. 5, the outer surface of the ring 100 wipes (slides) across the inner surface of the wall portion 34*a* of the cylinder 30*a*. The outer surface of the ring 100 continues to wipe across the inner surface of the wall portion 34*a* of the cylinder 30*a* until it reaches the position shown in FIG. 5.

During its wiping movement to the position shown in FIG. 5, the outer surface of the ring 100 moves a certain distance (designated with reference letter "A" in FIG. 5) across the inner surface of the wall portion 34*a* of the cylinder 30*a*. By allowing the outer surface of the ring 100 to wipe across the inner surface of the wall portion 34*a* of the cylinder 30*a*, the reliability of the electrical contact established between the ring 100 and the cylinder 30*a* is enhanced. The reliability enhancement arises because the wiping action helps to displace any small particles which may have come to rest between the outer surface of the ring 100 and the inner surface of the wall portion 34*a* of the cylinder 30*a*. Also, the rubbing action which arises from the wiping motion helps to penetrate any oxides, corrosion, or other non-conducting film, which may be present on the contact areas and thereby re-establish good electrical contact between the areas.

Figure 6:
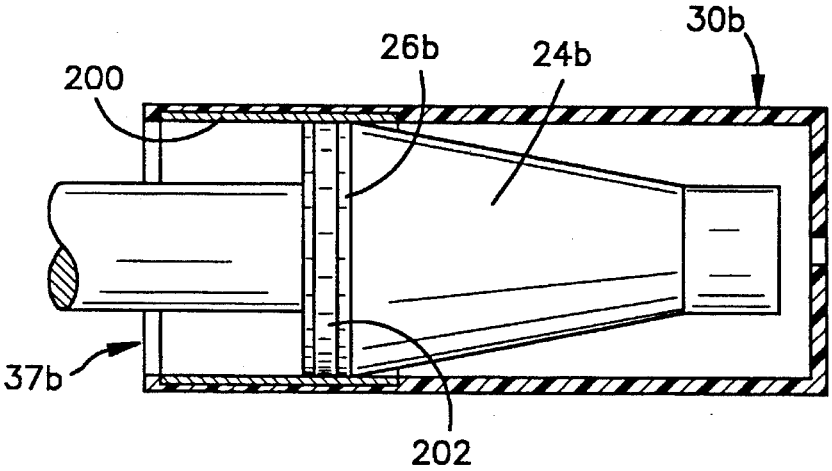
FIG. 6 is a view similar to FIG. 4 and showing a third embodiment of the present invention.

A third embodiment of the present invention is illustrated in FIG. 6. Since the embodiment of the invention illustrated in FIG. 6 is generally similar to the embodiment of the invention illustrated in FIGS. 1–4, similar numerals are utilized to designate similar components, the suffix letter "b" being added to the embodiment of FIG. 6 to avoid confusion.

Referring to FIG. 6, the mass (not shown) of the deceleration sensor switch (also not shown) is in an actuated position. The cylinder 30*b* is made of a plastic molded material having an internal plated first contact ring 200 adjacent to the open end 37b of the cylinder 30*b*. The first contact ring 200 is a first electrical contact. A second contact ring 202 is plated on the outside of the skirt end 26*b* of the cone 24*b*. The ring 202 is made of electrically conductive material and is a second electrical contact.

The first and second electrical contacts formed by the first and second contact rings 200, 202 are electrically connected with each other when the cone 24*b* is in the position shown in FIG. 6. The first and second electrical contacts formed by the first and second contact rings 200, 202 are the set of electrical contacts of the deceleration sensor switch. The contact closure time of the set of electrical contacts of the deceleration sensor switch in the embodiment of FIG. 6 is enhanced in the same way that the contact closure time of the first and second contacts 50, 52 of the deceleration sensor switch 10 in the embodiment of FIGS. 1–4 is enhanced. Also, in the embodiment of FIG. 6, the outer surface of the second contact ring 202 wipes across the inner surface of the first contact ring 200 in the same way as the outer surface of the ring 100 wipes across the inner surface of the wall portion 34*a* of the cylinder 30*a* in the embodiment of FIG. 5, as already described hereinabove.

Figure 7:
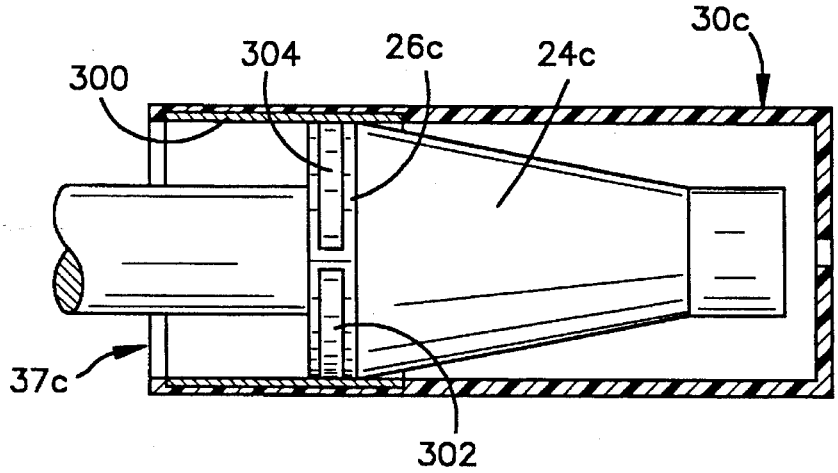
FIG. 7 is a view similar to FIG. 4 and showing a fourth embodiment of the present invention.

A fourth embodiment of the present invention is illustrated in FIG. 7. Since the embodiment of the invention illustrated in FIG. 7 is generally similar to the embodiment of the invention illustrated in FIGS. 1–4, similar numerals are utilized to designate similar components, the suffix letter "c" being added to the embodiment of FIG. 7 to avoid confusion.

Referring to FIG. 7, the mass (not shown) of the deceleration sensor switch (also not shown) is in an actuated position. The cylinder 30*c* is made of a plastic molded material having an internal plated contact ring 300 adjacent to the open end 37*c* of the cylinder 30*c*. A first arcuate contact portion 302 is plated on the outside of the skirt end 26*c* of the cone 24*c*. The first arcuate contact portion 302 is made of electrically conductive material and is a first electrical contact. A second arcuate contact portion 304 is plated on the outside of the skirt end 26*c* of the cone 24*c*. The second arcuate contact portion 304 is made of electrically conductive material and is a second electrical contact.

The first and second electrical contacts formed by the first and second arcuate contact portions 302, 304 are electrically connected with each other through the contact ring 300 when the cone 24*c* is in the position shown in FIG. 7. The first and second electrical contacts formed by the first and second arcuate contact portions 302, 304 are the set of electrical contacts of the deceleration sensor switch. The contact closure time of the set of electrical contacts of the deceleration sensor switch in the embodiment of FIG. 7 is enhanced in the same way that the contact closure time of the first and second contacts 50, 52 of the deceleration sensor switch 10 in the embodiment of FIGS. 1–4 is enhanced. In the embodiment of FIG. 7, the outer surface of the first arcuate contact portion 302 and the outer surface of the second arcuate contact portion 304 wipe across the inner surface of the contact ring 300 in the same way as the outer surface of the ring 100 wipes across the inner surface of the wall portion 34*a* of the cylinder 30*a* in the embodiment of FIG. 5, as already described hereinabove.

From the above description of the invention, those skilled in the art to which the present invention relates will perceive improvements, changes and modifications. Such improvements, changes and modifications within the skill of the art to which the present invention relates are intended to be covered by the appended claims.

Having described the invention, the following is claimed:

1. A device for enhancing contact closure time of a deceleration sensor switch having electrical contacts and a mass movable between an unactuated position in which the contacts are open and an actuated position in which the contacts are closed, said device comprising:

means for biasing the mass to the unactuated position in which the contacts are open;

first means connected with the mass for moving with the mass between the unactuated position and the actuated portion; and second means cooperating with said first means to create at least a partial vacuum which resists movement of the mass from the actuated position to the unactuated position, thereby enhancing contact closure time of the contacts.

2. A device according to claim 1 wherein said second means includes a cylinder having an open end and a closed end, said cylinder including a wall portion which defines a chamber between said open and closed ends, said cylinder having an inner diameter.

3. A deceleration sensor switch comprising:

electrical contacts;

a mass movable between an unactuated position in which said contacts are open and an actuated position in which said contacts are closed;

means for biasing the mass to the unactuated position in which the contacts are open; and means cooperating with said mass to create at least a partial vacuum which resists movement of said mass from the actuated position to the unactuated position, thereby enhancing contact closure time of said contacts.

4. A deceleration sensor switch comprising:

electrical contacts;

a mass movable between an unactuated position in which said contacts are open and an actuated position in which said contact contacts are closed;

means for biasing said mass towards the unactuated position;

a cylinder including an end portion and a cylindrical wall portion extending from said end portion and defining a chamber inside said cylinder, said end portion including means defining a metering orifice for allowing air to flow between said chamber and outside of said cylinder;

a shaft having a first end connected to said mass and a second end opposite said first end; and a truncated cone connected to said second end of said shaft and having a skirt end, said cone being movable in one direction relative to said chamber to displace air from said chamber through said metering orifice to outside of said cylinder upon said mass moving from the unactuated position to the actuated position in response to said mass being subjected to deceleration of at least a predetermined magnitude, said cone being movable in an opposite direction relative to said chamber to cause air from outside of said cylinder to flow through said metering orifice into said chamber upon said mass moving from the actuated position back to the unactuated position, thereby enhancing contact closure time of said contacts.

5. A deceleration sensor switch according to claim 4 wherein said cone comprises a polyimide material, and said wall portion of said cylinder comprises a metal material.

6. A deceleration sensor switch according to claim 5 further comprising an electrically conductive contact ring disposed on said cone, said contact ring being plated on said polyimide material and being electrically connected with said metal material of said wall portion of said cylinder when said cone is received in said chamber of said cylinder.

7. A deceleration sensor switch according to claim 4 wherein said cylinder comprises a plastic molded material.

8. A deceleration sensor switch according to claim 7 further comprising an internal plated electrically conductive first contact ring disposed on said plastic molded material of said cylinder.

9. A deceleration sensor switch according to claim 8 further comprising an electrically conductive second contact ring disposed on said cone and being electrically connected with said first contact ring when said cone is received in said chamber of said cylinder.

10. A deceleration sensor switch according to claim 8 further comprising (i) an electrically conductive first arcuate contact portion disposed on part of said cone and being electrically connected with said first contact ring when said cone is received in said chamber of said cylinder, and (ii) an electrically conductive second arcuate contact portion disposed on another part of said cone and being electrically connected with said first contact ring and thereby with said first arcuate contact portion when said cone is received in said chamber of said cylinder.

11. A deceleration sensor switch according to claim 4 wherein said skirt end of said truncated cone is compressed and fits snugly against an inner surface of said wall portion of said cylinder when said mass is in the actuated position, said cone being received in said chamber of said cylinder when said mass is in the actuated position.

12. A device for enhancing contact closure time of a deceleration sensor switch having electrical contacts and a mass moveable between an unactuated position in which the contacts are open and an actuated position in which the contacts are closed, said device comprising:

first means connected with the mass for moving with the mass between the unactuated position and the actuated position, said first means including a truncated cone and an extension shaft having one end connected with the mass and an opposite end connected with said cone and second means cooperating with said first means to create at least a partial vacuum which resists movement of the mass from the actuated position to the unactuated position, thereby enhancing contact closure time of the contacts, said second means including a cylinder having an open end and a closed end, said cylinder including a wall portion which defines a chamber between said open and closed ends, said cylinder having an inner diameter in which said cone is received in said chamber of said cylinder when said mass is in the actuated position.

13. A device according to claim 12 wherein said truncated cone includes a skirt end having an outer diameter which is larger than the inner diameter of said cylinder, said skirt end being compressed and fitting snugly against an inner surface of said wall portion of said cylinder when the mass is in the actuated position, said cone cooperating with said wall portion of said cylinder to create a partial vacuum in said chamber of said cylinder in response to the mass moving from the actuated position to the unactuated position, the partial vacuum resisting movement of the mass from the actuated position.

14. A device according to claim 12 wherein said cone comprises a polyimide material, and said wall portion of said cylinder comprises a metal material.

15. A device according to claim 12 further comprising an electrically conductive contact ring disposed on said cone, said contact ring being plated on said polyimide material and being electrically connected with said metal material of said wall portion of said cylinder when said cone is received in said chamber of said cylinder.

16. A device according to claim 12 wherein said cylinder comprises a plastic molded material.

17. A device according to claim 16 further comprising an internal plated electrically conductive first contact ring disposed on said plastic molded material of said cylinder and adjacent to said open end of said cylinder.

18. A device according to claim 17 further comprising an electrically conductive second contact ring disposed on said cone and being electrically connected with said first contact ring when said cone is received in said chamber of said cylinder.

19. A device according to claim 17 further comprising (i) an electrically conductive first arcuate contact portion disposed on part of said cone and being electrically connected with said first contact ring when said cone is received in said chamber of said cylinder, and (ii) an electrically conductive second arcuate contact portion disposed on another part of said cone and being electrically connected with said first contact ring and thereby with said first arcuate contact portion when said cone is received in said chamber of said cylinder.

* * * * *